US009648931B2

(12) United States Patent
Sha et al.

(10) Patent No.: US 9,648,931 B2
(45) Date of Patent: May 16, 2017

(54) WALLET WITH SECURING STRAP

(71) Applicants: Robert Sha, Pasadena, CA (US); David Sha, San Francisco, CA (US)

(72) Inventors: Robert Sha, Pasadena, CA (US); David Sha, San Francisco, CA (US)

( * ) Notice: Subject to any disclaimer, the term of this patent is extended or adjusted under 35 U.S.C. 154(b) by 0 days.

(21) Appl. No.: 14/602,454

(22) Filed: Jan. 22, 2015

(65) Prior Publication Data

US 2015/0129096 A1 May 14, 2015

Related U.S. Application Data

(63) Continuation-in-part of application No. 29/439,460, filed on Dec. 11, 2012, now Pat. No. Des. 723,798.

(51) Int. Cl.
*A45C 1/06* (2006.01)

(52) U.S. Cl.
CPC ..... *A45C 1/06* (2013.01); *A45C 2001/062* (2013.01); *A45C 2001/065* (2013.01)

(58) Field of Classification Search
CPC .... A45C 1/06; A45C 2001/062; A45C 11/182
USPC ..... 150/122, 124, 141, 144, 147, 132, 134
See application file for complete search history.

(56) References Cited

U.S. PATENT DOCUMENTS 1,230,100 A 6/1917 Blanchard
1,265,824 A * 5/1918 Smith ..... A45F 5/022 150/134
1,310,321 A * 7/1919 Holland ..... F01P 11/16 220/212
4,083,321 A * 4/1978 LeBron ..... G08B 13/149 116/84
4,945,961 A * 8/1990 Healy ..... A45C 1/06 150/132
5,653,276 A 8/1997 Niernberger
D435,339 S * 12/2000 Cleveland ..... A45C 1/06 D3/247
D436,339 S * 1/2001 Fitzgerald ..... D12/209
8,667,998 B1 * 3/2014 Westrick ..... A45C 1/06 150/147
D703,949 S * 5/2014 Chappell ..... D3/249
2006/0249234 A1 * 11/2006 Lin ..... A45C 11/182 150/147
2010/0139049 A1 * 6/2010 Glickfield ..... A44C 5/003 24/3.7
2011/0272072 A1 * 11/2011 Westover ..... A45C 1/08 150/147
2012/0168483 A1 * 7/2012 Jambunathan ..... A45C 11/00 224/576
2013/0031990 A1 * 2/2013 Singh ..... F16H 3/006 74/330
2013/0056119 A1 3/2013 Henriette
2013/0276943 A1 10/2013 Minn et al.
2015/0327637 A1 * 11/2015 Weber ..... A45C 1/06 150/132

* cited by examiner

*Primary Examiner* — Sue A Weaver
(74) *Attorney, Agent, or Firm* — Jeffrey G. Sheldon; Leech Tishman Fuscaldo & Lampl

(57) ABSTRACT

A non-folding wallet has a front wall, a rear wall and four side edges. Three of the side edges are closed and the fourth is open to provide access to a compartment defined between the front and rear walls. The rear wall defines a rear wall opening. A securing strap is attached at a top edge and a bottom edge to the front wall.

2 Claims, 12 Drawing Sheets

WALLET WITH SECURING STRAP

CROSS-REFERENCE TO RELATED APPLICATION

This application is a Continuation-in-Part of U.S. patent application Ser. No. 29/439,460, entitled "Wallet," filed Dec. 11, 2012 the contents of which are incorporated herein by reference in their entirety.

BACKGROUND OF THE INVENTION

Wallets are well known. Traditional folding wallets of the prior art, however, are typically unduly large, thick, heavy and awkward to use.

"Card case" style wallets with a money carrying feature (i.e., a money clip, either metal or magnetic, or an elastic band-containing wallet) are also known, but entail their own set of problems:

Metal clips don't allow for dramatic fluctuation of bill quantities. Thus, one cannot put in 30+ bills easily and then try to go down to only 1 bill (because the metal is generally flexed in such a way that the tension no longer holds a single bill securely). Much like a paper clip that has been flexed outward on a large stack of paper, if one tries to then secure just two sheets, one has to bend the paper clip back to its original state to get enough tension. Paper clips however allow one to bend past the 0 degrees to get the tension correct. The metal in money clips, however, generally doesn't allow one to bend past 0 degrees, so one is left with a permanent gap unless one uses pliers or a vise on the edge to pinch the metal back down. Also metal clips are structurally bulky regardless of the amount of items being held in the clip. Metal clips also tend to wear through materials like pocket linings and pans materials. Even when wrapped in leather, metal clips tend to cut through clothing materials.

Magnetic clips (the kind where two magnets are sandwiched between pieces of leather or fabric and folded on itself via a "hinge") are also generally bulky regardless of the amount of items being held within. Also, the magnetic options have a fault in that the more bills one folds underneath, the less the magnets are able to hold, since the distance between the magnets is being placed further and further apart with each added bill.

SUMMARY OF THE INVENTION

The invention addresses these problems. The invention is a non-folding wallet which comprises a front wall, a rear wall and four side edges. Three of the side edges are closed and the fourth is open to provide access to a compartment defined between the front and rear walls. The rear wall defines a rear wall opening. A securing strap is attached to the front wall.

DRAWINGS

These and other features, aspects and advantages of the present invention will become better understood with reference to the following description, appended claims, and accompanying drawings where:

DETAILED DESCRIPTION OF THE INVENTION

Figure 1:
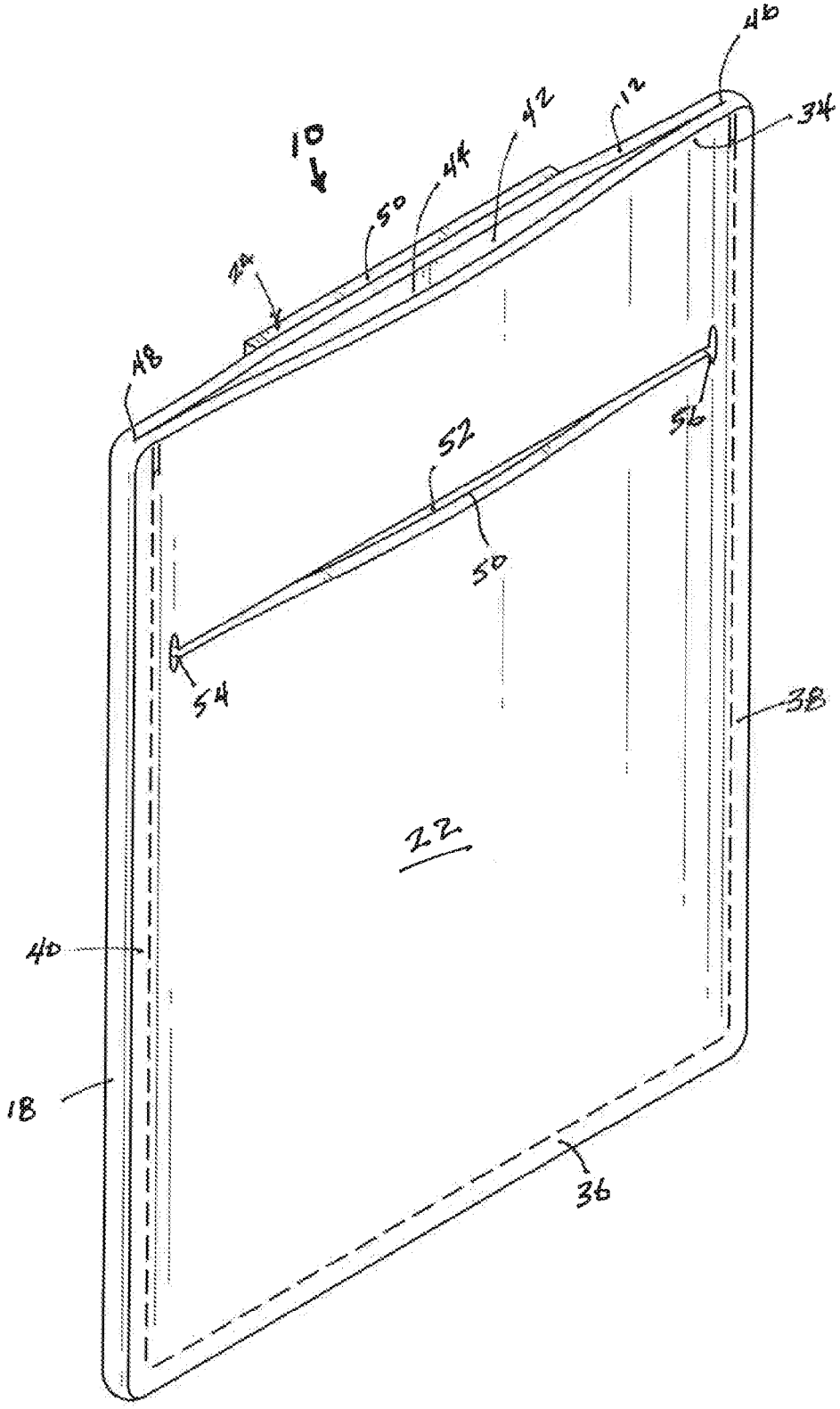
FIG. 1 is a rear and side perspective view of a first wallet having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

Definitions

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers, ingredients or steps.

The Invention

The invention is a wallet 10 having an open wallet top edge 12, a closed wallet bottom edge 14, a closed first wallet side edge 16 and a closed second wallet side edge 18. The wallet 10 further comprises a front wall 20, a rear wall 22 and a securing strap 24.

The front wall 20 has a front wall top side edge 26, a front wall bottom edge 28, a front wall first side edge 30 and a front wall second side edge 32.

The rear wall 22 has a rear wall top side edge 34, a rear wall bottom side edge 36, a rear wall first side edge 38 and a rear wall second side edge 40.

Each rear wall side edge is aligned with a front wall side edge. The rear wall bottom side edge 36 is permanently attached to the front wall bottom side edge 28, the rear wall first side edge 38 is permanently attached to the front wall first side edge 30 and the rear wall second side edge 40 is permanently attached to the front wall second side edge 32—so as to form the closed. wallet bottom edge 14, the closed first wallet side edge 16 and the closed second wallet side edge 18, and to thereby define an interior pocket 42 between the front wall 20 and the rear wall 22 with closed bottom edge 14, with closed side edges 16 and 18, and with a wallet top edge opening 44. In the embodiments illustrated in the drawings, the wallet top edge opening 44 is defined between a first wallet top edge opening end 46 proximate to the first wallet side edge 16 and at a second top edge opening end 48 proximate to the second wallet side edge 18.

The rear wall 22 defines a rear wall opening 50 which provides access to a rear wall opening compartment 52 within the interior of the wallet 10. The rear wall 50 is preferably defined proximate to the wallet top edge 12 and extends laterally between the first wallet side edge 38 and the second wallet side edge 40. In the embodiments illustrated in the drawings, the rear wall opening 50 is a slit opening defined between a first slit opening end 54 proximate to the rear wall first side edge 38 and at a second slit opening end 56 proximate to the rear wall second side edge 40.

The rear wall opening compartment 52 is disposed within the interior pocket 42 and typically provides a compartment separate the compartment provided by the interior pocket 42. In some embodiments, however, the rear wall opening compartment 52 can coincide with the compartment provided by the interior pocket 42.

The front wall 20 and the rear wall 22 can be made from leathers, plastics, rubbers, textiles or other suitable materials. The permanent attachment of the front wall and rear wall side edges can be efficiently accomplished by stitching (as illustrated in the drawings), by rivets, by fusion, by molding (such as by a 3-D print process), or by other suitable permanent attachment methods.

The wallet 10 can be sized to secure a wide variety of currency sizes and card sizes. In a typical embodiment, the wallet 10 is sized and dimensioned to be retained within the hip pocket of a pair of pants and/or the breast pocket of a shirt. The wallet 10 is typically rectangular in shape.

The rear wall opening 50 and the wallet top edge opening 44 are preferably adapted to accept and retain credit cards, membership cards, ID cards, business cards, etc.

The securing strap 24 has a securing strap top edge 58, a securing strap bottom edge 60, a securing strap first side edge 62 and a securing strap second side edge 64. The securing strap top edge 58 and the securing strap bottom edge 60 are attached to the front wall 20. The securing strap first side edge 62 and the securing strap second side edge 64, however, are not substantially secured to the front wall 20. By "not substantially secured to the front wall 20" it is meant that the securing strap first side edge 62 and the securing strap second side edge 64 are not secured to the front wall 20 at any location along their lengths which would prevent the insertion of cash (or credit cards, membership cards, ID cards, business cards, other cards, other loose items such as receipts, tickets, ticket stubs, etc.) between the securing strap 24 and the front wall 20 at either of the securing strap side edges 62 or 64.

The permanent attachment of the securing strap top edge 58 to the front wall 20 and the can be accomplished by stitching (as illustrated in the drawings), by rivets, by fusion, by molding (such as by a 3-D print process), or by other suitable permanent attachment methods.

In the embodiments illustrated in the drawings, the securing strap top edge 58 is attached proximate to the front wall top side edge 26 and the securing strap bottom edge 60 is attached proximate to the front wall bottom side edge 28. Also as illustrated in the drawings, the first securing strap side edge 62 is typically not disposed proximate to a front wall side edge 30 and the second securing strap side edge 64 is not disposed proximate to a front wall side edge 32. Preferably, the width of the securing strap 24 is sufficient to allow the securing and retention of paper money folded only once.

Typically, the width of the securing strap 24 is uniform and is between about 40% and about 60% of the width of the wallet 10. In one embodiment, the width of the securing strap 24 is about 50% of the width of the wallet 10.

The securing strap 24 can be made from leather or from other suitable materials, both elastic and non-elastic. A reinforcement plate can be incorporated into the securing strap 24 to minimize the general tendency of the securing strap material (e.g., leather) to stretch.

Figure 2:
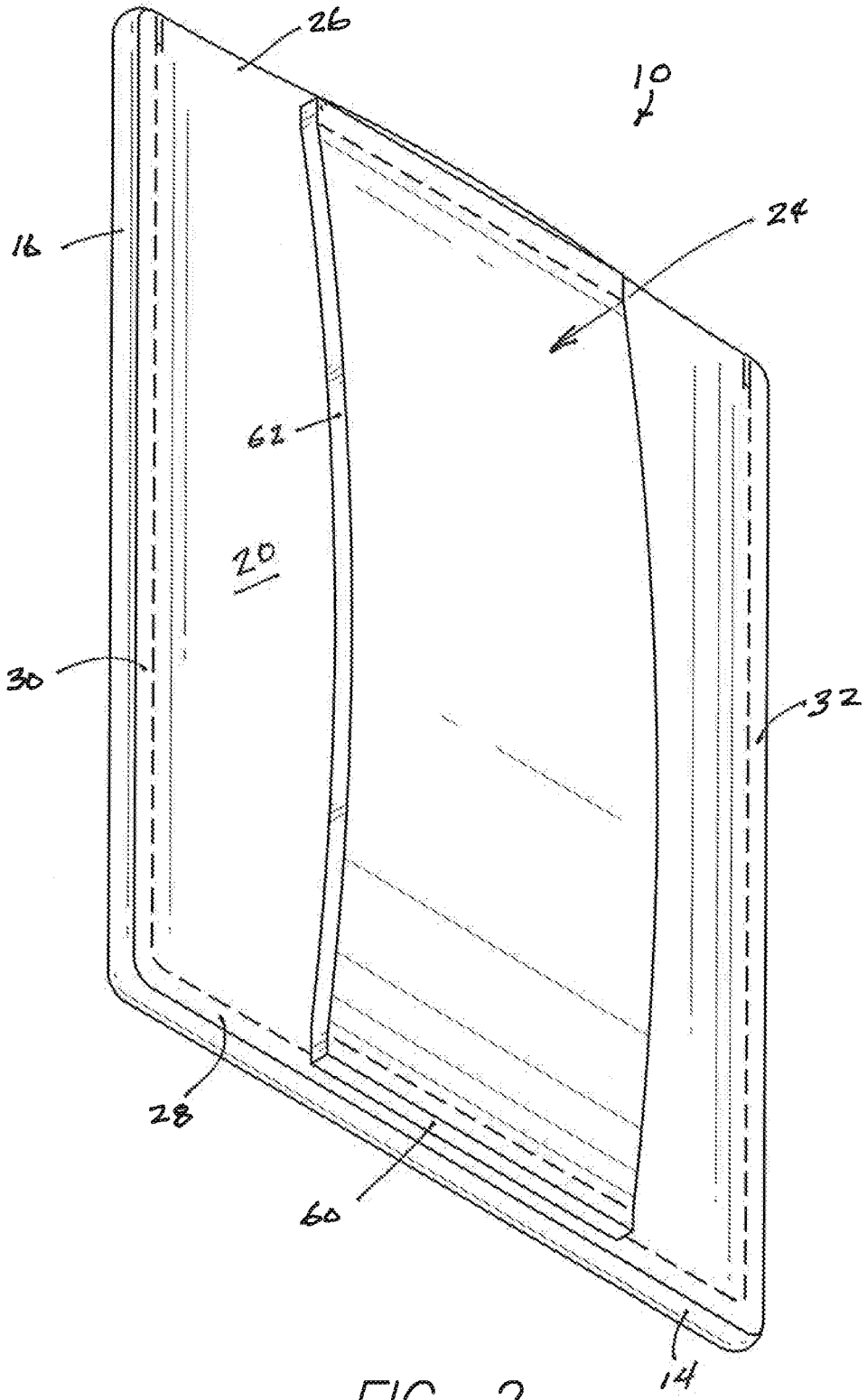
FIG. 2 is a front and side perspective of the wallet of FIG. 1.
Figure 3:
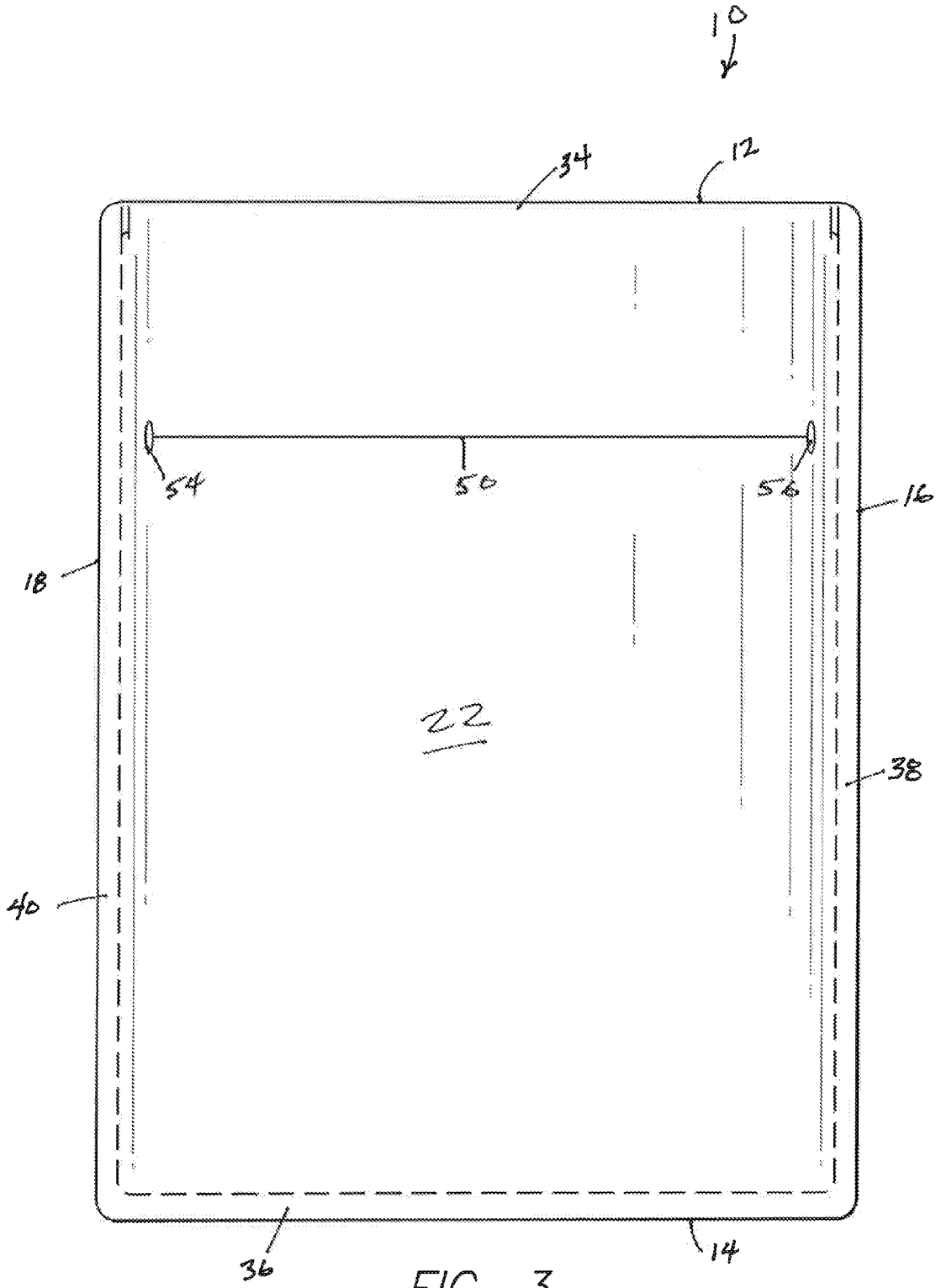
FIG. 3 is a rear plan view of the wallet of FIG. 1.
Figure 4:
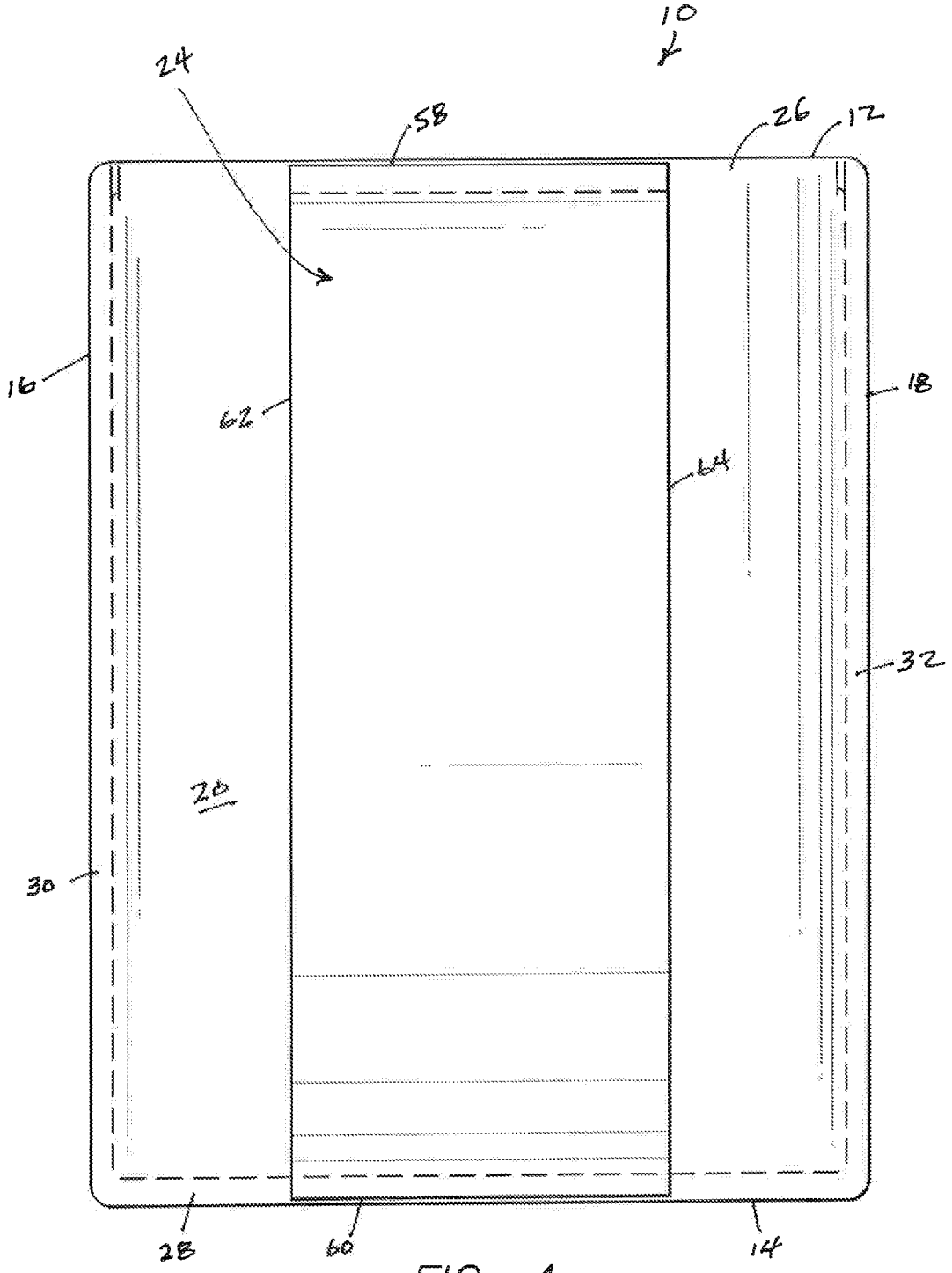
FIG. 4 is a front plan view of the wallet of FIG. 1.
Figure 5:
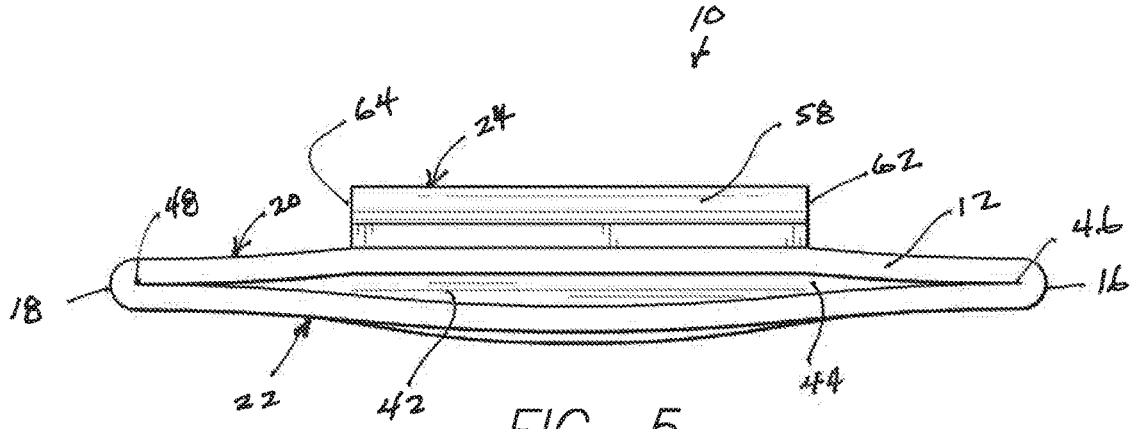
FIG. 5 is a top elevation view of the wallet of FIG. 1.
Figure 6:
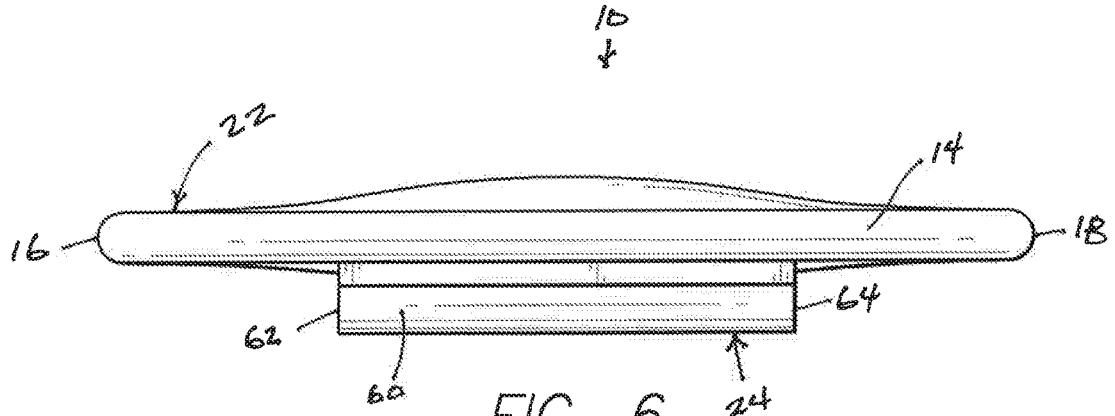
FIG. 6 is a bottom elevation view of the wallet of FIG. 1.
Figure 7:
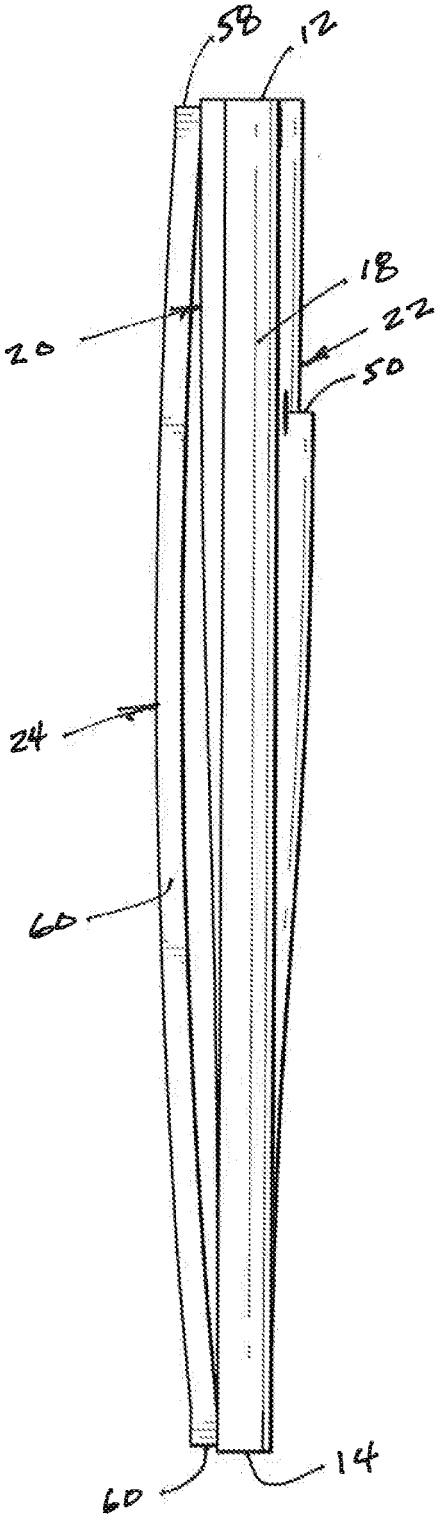
FIG. 7 is a side elevation view of the wallet of FIG. 1.
Figure 8:
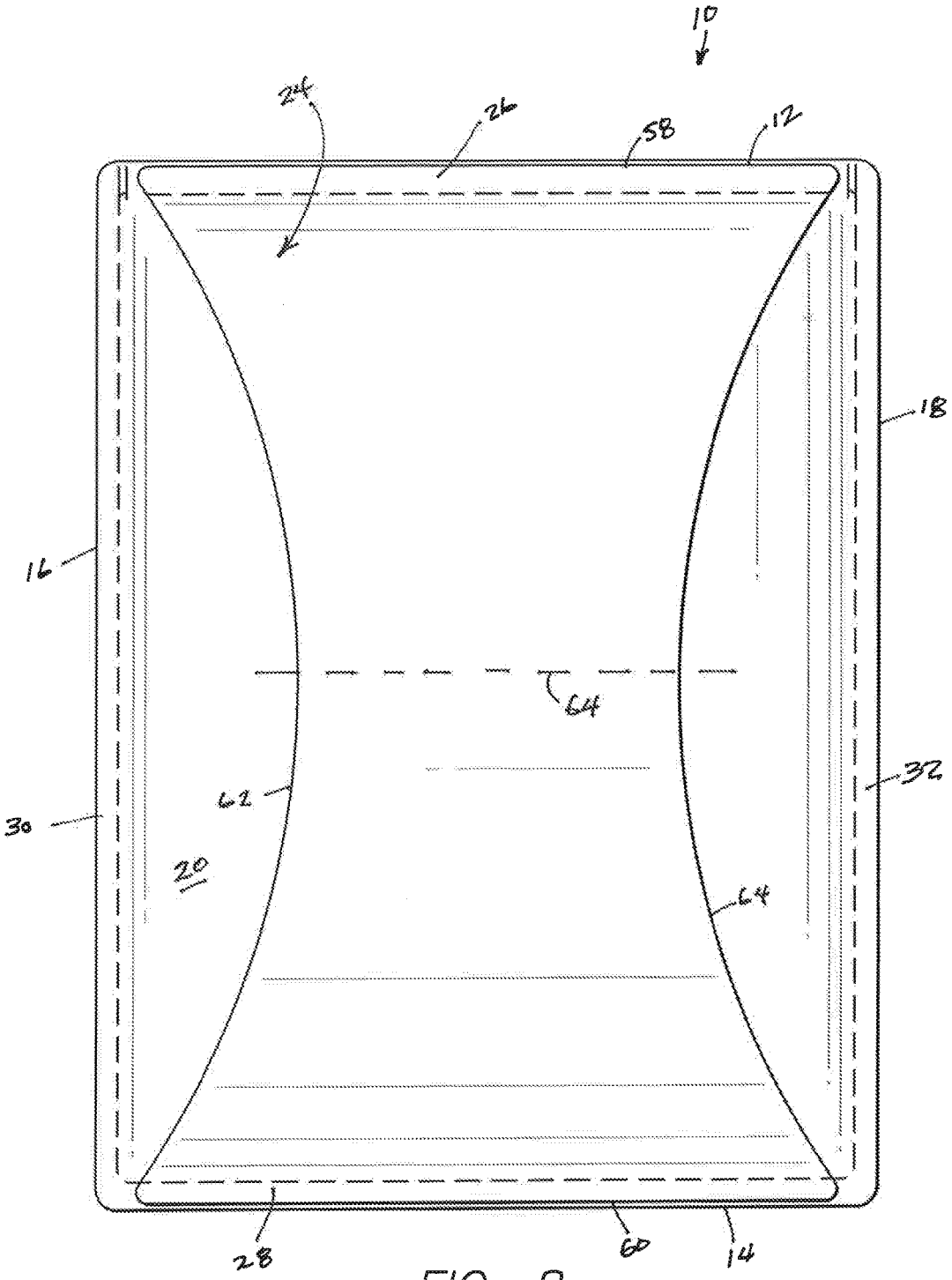
FIG. 8 is a front view of a second wallet having features of the invention.
Figure 9:
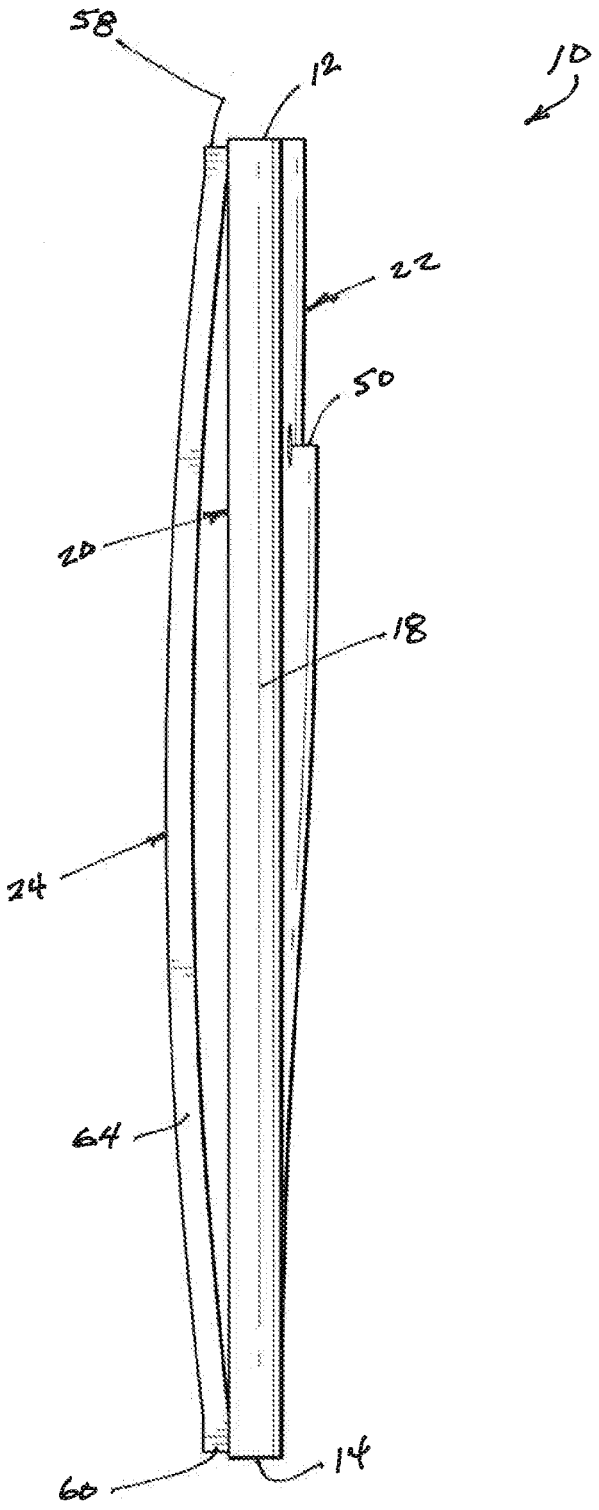
FIG. 9 is a side elevation view of the wallet of FIG. 8.
Figure 10:
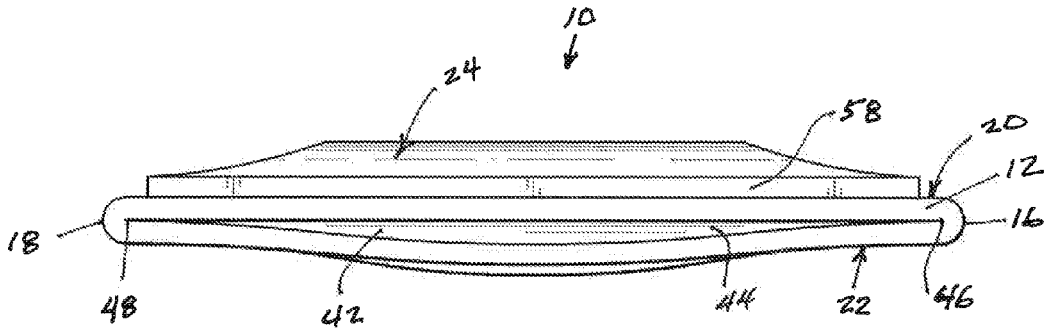
FIG. 10 is a top elevation view of the wallet of FIG. 8.
Figure 11:
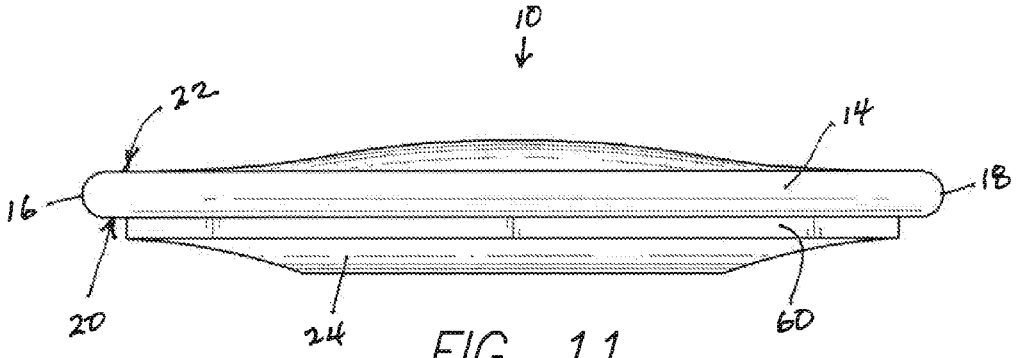
FIG. 11 is a bottom view of the wallet of FIG. 8.
Figure 12:
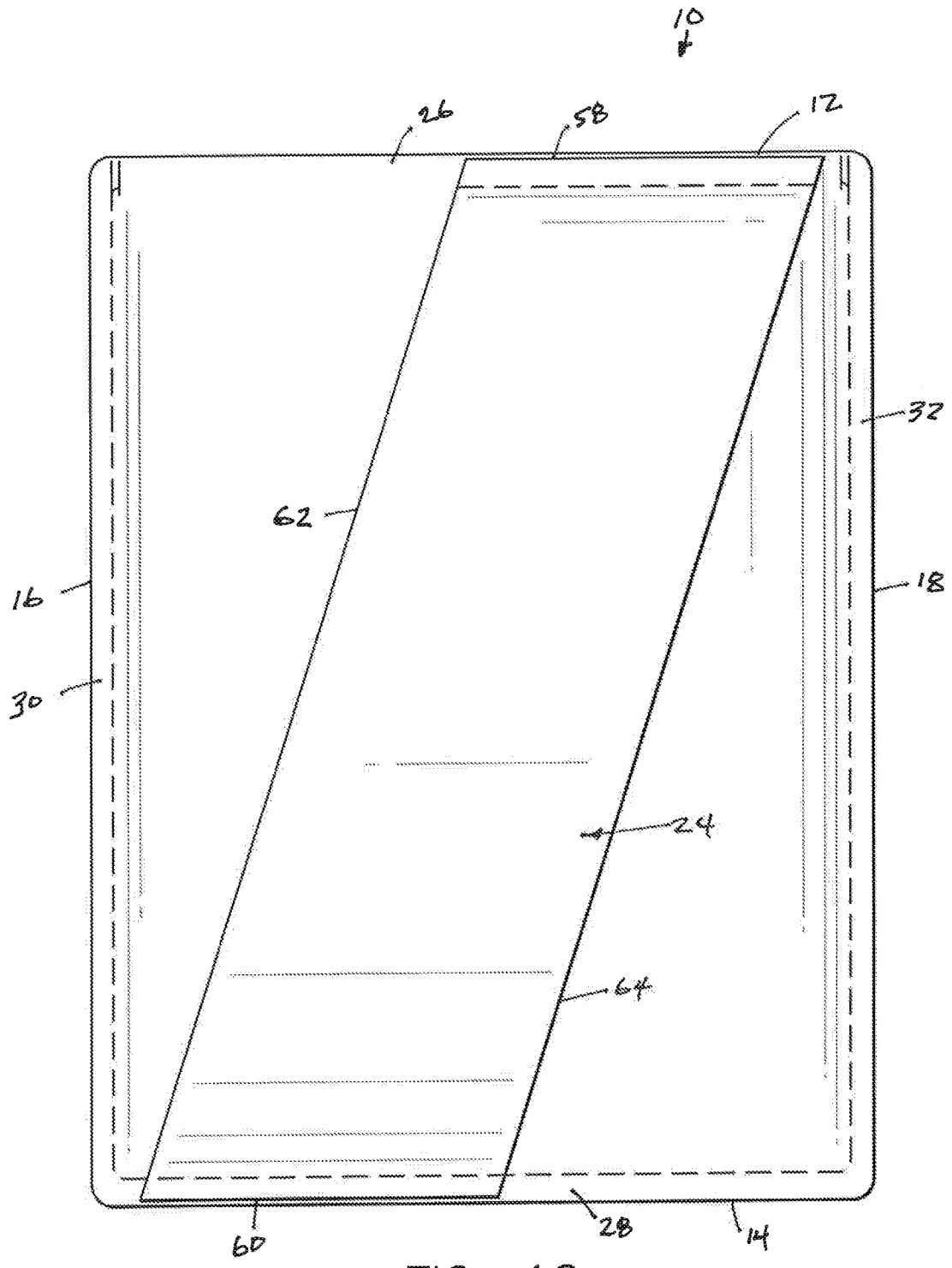
FIG. 12 is a front view of a third wallet having features of the invention.
Figure 13:
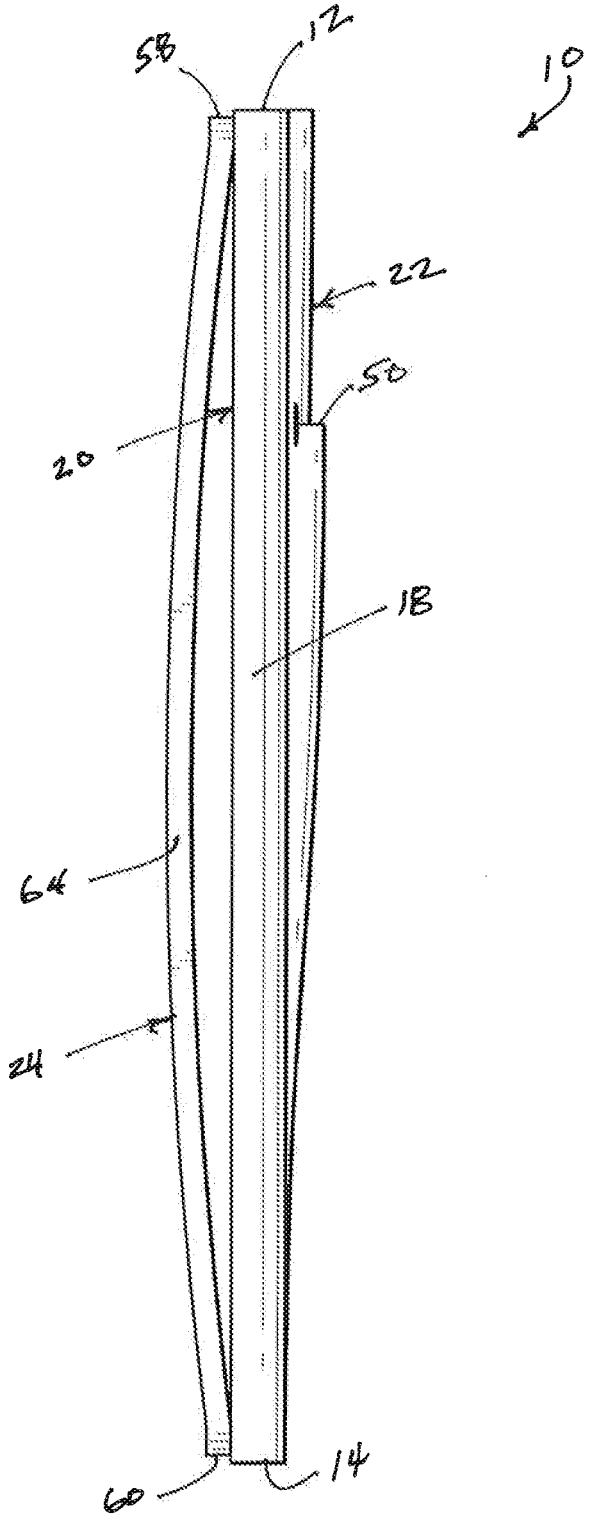
FIG. 13 is a side elevation view of the wallet of FIG. 12.
Figure 14:
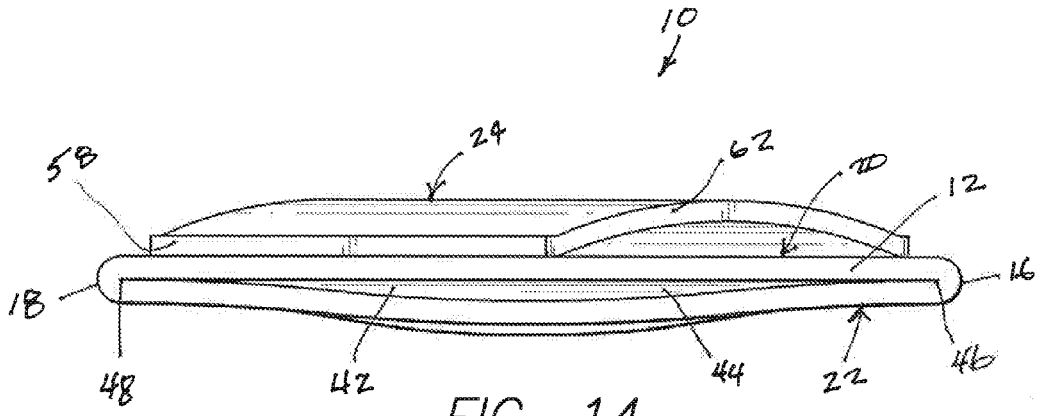
FIG. 14 is a top elevation view of the wallet of FIG. 12.
Figure 15:
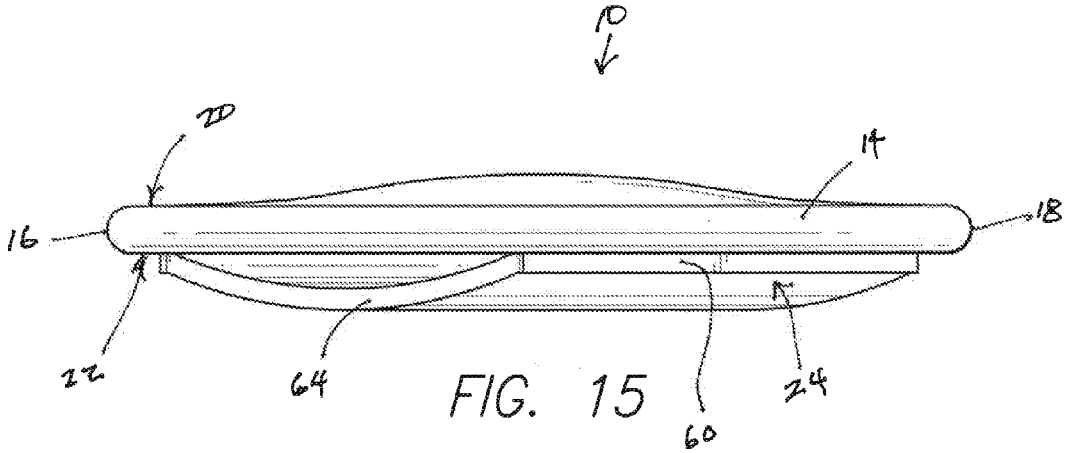
FIG. 15 is a bottom view of the wallet of FIG. 12.

In the embodiment illustrated in FIGS. 1-7, the securing strap 24 is rectangular in shape. In the embodiment illustrated in FIGS. 8-11, the securing strap 24 is a parallelogram in shape. In the embodiment illustrated in FIGS. 12-15, the securing strap first side edge 62 and the securing strap second side edge are both arcuate with the securing strap first side edge 62 and the securing strap second side edge 64 being most proximate to one another at a central location 66 distal from the securing strap top edge 58 and the securing strap bottom edge 60.

The securing strap 24 can be conveniently used for securing cash, currency, credit cards, membership cards, ID cards, business cards, other cards, other loose items such as receipts, tickets, ticket stubs, etc.

The invention provides a wallet 10 which is considerably less bulky than traditional folding wallets, but which can be used with more efficiency. The securing strap 24 allows one to secure a very large number of bills (typically, as many as 40-50 bills) and alternatively allows one to secure a single bill—even immediately after a large number of bills were accommodated.

The invention is superior to most "card case" style wallets with a money carrying feature because the invention holds a wide range of currency and card thicknesses with suffering from metal distortion problems and weakened magnetism problems. Also, the invention is not inherently bulky in structure and does not have a tendency to wear through clothing.

Having thus described the invention, it should be apparent that numerous structural modifications and adaptations may be resorted to without departing from the scope and fair meaning of the instant invention as set forth herein above and described herein below by the claims.

What is claimed is:

1. A wallet having a wallet top edge, a closed wallet bottom edge, a closed first wallet side edge and a closed second wallet side edge, the wallet further comprising:

a) a front wall having a front wall top side edge, a front wall bottom edge, a front wall first side edge and a front wall second side edge;

b) a rear wall having a rear wall top side edge, a rear wall bottom side edge, a rear wall first side edge and a rear wall second side edge, each rear wall side edge being aligned with a front wall side edge, the rear wall bottom side edge being stitched to the front wall bottom side edge, the rear wall first side edge being stitched to the front wall first side edge and the rear wall second side edge being stitched to the front wall second side edge, to form the closed wallet bottom edge, the closed first wallet side edge and the closed second wallet side edge, and to thereby define an interior pocket between the front wall and the rear wall with closed bottom and side edges and with a wallet top edge opening, the rear wall defines a rear wall opening; and c) a securing strap having a securing strap top edge, a securing strap bottom edge, a securing strap first side edge and a securing strap second side edge, the securing strap top edge and the securing strap bottom edge are secured to the front wall, wherein the securing strap first side edge and the securing strap second side edge are not substantially secured to the front wall, and wherein the securing strap is a parallelogram in shape;

wherein:

(i) the wallet is rectangular in shape;

(ii) the rear wall opening is defined proximate to the wallet top edge and extends laterally between the first wallet side edge and the second wallet side edge;

(iii) the securing strap top edge is attached proximate to the front wall top side edge and the securing strap bottom edge is attached proximate to the front wall bottom side edge; and (iv) the securing strap first side edge is not disposed proximate a front wall side edge and the securing strap second side edge is not disposed proximate a front wall side edge.

2. The wallet of claim 1 wherein the rear wall opening and the wallet top edge opening are adapted to accept and retain credit cards, membership cards, ID cards or business cards, or any combination thereof.

* * * * *